US007263327B2

(12) United States Patent
Nagayama

(10) Patent No.: US 7,263,327 B2
(45) Date of Patent: Aug. 28, 2007

(54) IMAGE FORMING APPARATUS

(75) Inventor: Akihito Nagayama, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/944,280

(22) Filed: Sep. 17, 2004

(65) Prior Publication Data

US 2005/0158095 A1 Jul. 21, 2005

(30) Foreign Application Priority Data

Sep. 18, 2003 (JP) ..... 2003-325544

(51) Int. Cl.
*G03G 15/00* (2006.01)
*B41J 13/10* (2006.01)

(52) U.S. Cl. ..... 399/405; 400/625; 400/693

(58) Field of Classification Search ..... 399/397, 399/405; 400/625, 691, 692, 693
See application file for complete search history.

(56) References Cited

U.S. PATENT DOCUMENTS 4,891,678 A * 1/1990 Ishizu et al. ..... 399/91
6,134,418 A * 10/2000 Kato et al. ..... 399/405
2004/0018034 A1* 1/2004 Baek et al. ..... 399/405

FOREIGN PATENT DOCUMENTS

JP 06130630 A * 5/1994

* cited by examiner

*Primary Examiner*—Ren Yan
(74) *Attorney, Agent, or Firm*—patenttm.us; James H. Walters

(57) ABSTRACT

Problem

The object is to provide an image-forming apparatus which is capable of releasing the heat generated in the apparatus without incorporating a fan.

Means for Solving the Problem

Three ribs 17 are provided to rise on the surface of a recording sheet-receiving tray 16 and to extend in the sheet discharge direction (arrow A direction) The three ribs 17 are arranged in the width direction of the recording paper sheet P held on the sheet-receiving tray 16. The number of the ribs 17 may be two, or four or more, regardless of the three ribs 17 as an example. The sheet-receiving tray 16 has many apertures 16*a*, 16*b* for connection of the inside of the casing 12 to the outside thereof. The heat generated by a polygon mirror-driving motor 18*c*, a fixation assembly 36, and so forth is released through many apertures 16*a*, 16*b*, 12*a*. Therefore, the laser beam printer 10 does not employ a fan for removing the heat from inside of the casing 12.

18 Claims, 11 Drawing Sheets

IMAGE FORMING APPARATUS

TECHNICAL FIELD

The present invention relates to an image-forming apparatus which has a recording medium-receiving tray for holding a recording medium having an image recorded formed thereon.

BACKGROUND TECHNIQUE

The image-forming apparatus for forming an image on a recording medium by an electrophotographic image-forming process includes electrophotographic copying machines, electrophotographic printers (such as LED printers, and laser beam printers), electrophotographic facsimile machines, and electrophotographic word processors.

The image-forming apparatus like those mentioned above comprises a fixation assembly for fixing an unfixed toner image, a polygon mirror-driving motor for rotating a scanner for projecting image data onto a photosensitive member at a high rotation speed, an electronic assembly, and so forth. The fixation assembly, the polygon mirror-driving motor, and the electronic assembly generate heat. For removing the generated heat, the image-forming apparatus usually contains a ventilator like a fan, and has an air inlet for introducing outside air therein and an air outlet for expelling the inside air. When the image-forming apparatus is placed in a room, the air inlet and the air outlet of the apparatus should be kept apart from the room wall at a certain distance.

DISCLOSURE OF THE INVENTION

Problem to Be Solved by the Invention

In recent years, many image-forming apparatuses are used in SOHOs (small offices/home offices) and ordinary families, so that the image-forming apparatuses are demanded to be smaller in size, to generate less noise, to occupy less space, and to be less expensive. For downsizing of the image-forming apparatus, the parts and members are necessarily placed closely. For preventing the adverse effects of the heat generated by the aforementioned heat-generating parts and members, a fan is necessarily incorporated in the downsized apparatus in most cases.

The fan driven in the apparatus generates noise during the operation. The noise of the driven fan in a quiet office can make persons uneasy or disturb the office work. Moreover, the image-forming apparatus having a fan incorporated should be placed apart at a certain distance from the room wall, requiring additional space.

Therefore, the present invention intends to provide an image-forming apparatus which does not need a fan for removing the heat from inside of the apparatus.

Means for Solving the Problem

To achieve the above object, the image-forming apparatus of the present invention has a sheet discharge port for discharging a recording medium sheet having an image formed thereon in a prescribed sheet discharge direction, and a sheet-receiving tray extending from under the sheet discharge port in the sheet discharge direction for receiving the recording medium sheet; and discharging the recording medium sheet having the image formed thereon from the sheet discharge port onto the sheet-receiving tray; wherein (1) the sheet-receiving tray has apertures to connect the inside of the apparatus body to outside air, and (2) the sheet-receiving tray may have ribs rising from the surface thereof, extending in the sheet discharge direction, and having openings.

(3) The ribs are constituted of three or more ribs arranged in the width direction of the recording medium sheet held on the sheet-receiving tray, and (4) of the three or more ribs, the ribs at the end portions in the width direction may be higher than that at the middle portion.

Further, (5) the sheet-receiving tray may have, on the surface thereof, projections having apertures for connection of the inside of the apparatus body to the outside thereof, the apertures facing to the direction perpendicular to the sheet discharge direction.

Further, (6) the protrusion may have an aperture facing to the downstream side of the sheet discharge direction for connection of the inside of the apparatus body to the outside thereof.

Further, (7) the protrusion may have an upper face tilting to become lower from the outer side toward the inner side in the width direction of the recording medium held on the sheet-receiving tray.

Further, (8) the apparatus has a fixation assembly for fixing the image by heating, and (9) the sheet-receiving tray may be placed above the fixation assembly.

Further,

(10) the apparatus may have an electronic assembly incorporating electric and electronic parts, and

(11) a stay having apertures for passing air upward for supporting the electronic assembly

EFFECT OF THE INVENTION

The image-forming apparatus of the present invention has apertures on the recording medium-receiving tray to connect the inside of the apparatus body to the outside for releasing the heat generated in the apparatus to the outside. Therefore, the heat generated in the apparatus body is released through the apertures without a ventilator. This makes unnecessary the ventilating fan, enabling a smaller size, less noise generation, a smaller installation space, and a lower cost of the apparatus.

BEST MODE FOR CARRYING OUT THE INVENTION

EXAMPLE 1

A laser beam printer, as an example of the image-forming apparatus of the present invention, is explained by reference to FIGS. 1 to 5.

FIG. 1 is a side view illustrating the constitution of the laser beam printer of this Example. FIG. 2 is a side view of the laser beam printer of FIG. 1 holding a recording medium sheet on a sheet-receiving tray. FIG. 3 is a side view showing the flow of the heat. FIG. 4 is a perspective view of the sheet-receiving tray. FIG. 5 is a front view showing the shape of ribs on the sheet-receiving tray.

The laser beam printer 10 has a rectangular casing 12 enclosing various parts and devices. Under the casing 12, sheet-feeding cassette 14 is equipped demountably for holding recording paper sheets P (an example of the recording medium) At the portion above the fixation assembly 36 mentioned later of the casing 12, many apertures 12*a* are formed.

On the upper face of the casing 12, a sheet-receiving tray (discharged sheet tray) 16 is provided for holding the recording paper sheet P having discharged after image formation. The sheet-receiving tray 16 is inclined to rise from the upstream side to the downstream side in the sheet discharge direction (arrow A direction).

On the face of the sheet-receiving tray 16, three ribs 17 are provided which rise from the face and extend to the sheet discharge direction (arrow A direction mentioned later). The three ribs 17 are arranged in the direction of width of the recording paper sheet P (arrow W direction) held on the sheet-receiving tray 16 as shown in FIG. 4. Although three ribs 17 are shown in this example, two ribs, or four or more ribs 17 may be provided. However, the number of the ribs is preferably three or more. The sheet-receiving tray 16 has many apertures 16i a,16*b* to connect the inside of the casing 12 (inside of the apparatus main body in the present invention) to the outside. The heat from the polygon mirror-driving motor 18*c* and fixation assembly 36 mentioned later is released through the many apertures 16*a*,16*b*,12*a* to the outside. Therefore, the laser beam printer 10 has no fan for heat removal from the inside of the casing 12.

Inside the casing 12, an optical unit 18 is provided which emits a laser beam 18*a* carrying an image information. The optical unit 18 comprises a polygon mirror 18*b* for reflecting an imaging light beam (laser beam carrying the image information), a polygon mirror-driving motor 18*c* for rotating the polygon mirror 18*b*, a focusing lens 18*d* for focusing the imaging light reflected by the polygon mirror 18*b*, and a reflection mirror 18*e* for reflecting the imaging light.

Below the optical unit, a process cartridge 20 is placed which encloses a photosensitive drum 22, a developing assembly 24, and so forth in integration. The laser beam 18*a* emitted from the optical unit 18 is projected to the photosensitive drum 22 to form an electrostatic latent image on the photosensitive drum 22. Around the photosensitive drum 22, are provided electrifier 26 for electrifying uniformly the photosensitive drum 22, a cleaning member 28 for removing the unfixed toner remaining on the photosensitive drum, and so forth.

For recording an image on the recording paper sheet P, the recording paper sheets P held in the sheet-feeding cassette 14 are fed one by one by a feeding roller 30. The fed recording paper sheet P is pinched and delivered by a delivery roller (not shown in the drawing) to a halting registration roller 32.

The registration roller 32 serves to adjust a front edge position of the recording paper sheet P and a front edge position of the developed image on the photosensitive drum 22 to form the image on a prescribed position of the recording paper sheet P. The recording paper sheet P is delivered by the registration roller 32 to a transfer roller 34 in accordance with the timing of arrival of the developed image on the photosensitive drum 22 to the transfer roller 34. Thereby, the developed image is transferred onto the recording paper sheet P. The recording paper sheet P having received the transferred image is delivered to a fixation assembly 36 for fixing the transferred developed image by heat and pressure onto the recording paper sheet P. A sheet-receiving tray 16 is provided above the fixation assembly 36. The recording paper sheet P having passed the fixation assembly 36 is pinched by a pair of first sheet-discharging rollers 38 and a pair of second sheet-discharging rollers 40 and is discharged from sheet discharge port 42 in the arrow A direction (an example of paper sheet discharge direction) onto the sheet-receiving tray 16.

The casing 12 comprises also a sheet delivery guide 44 for guiding the recording paper sheet P from the registration roller 32 to a fixation assembly 36, an electronic assembly 46 containing electronic parts, a main motor 48 for driving a driving parts of the laser beam printer 10, and like parts.

Of the aforementioned parts and members enclosed in the casing 12, the polygon mirror-driving motor 18*c*, the fixation assembly 36, the electronic assembly 46, the main motor 48, and so forth generate heat.

The heat generated by the polygon mirror-driving motor 18*c* is removed as explained below The optical unit 18 has a cover plate 19 which is heat-conductive and increases the heat radiation effect. Just above the covering plate 19, there are provided many apertures 16*a*. The heat generated by the polygon mirror-driving motor 18*c* is conducted to the cover plate 19, and is released through the apertures 16*a* in the arrow B direction.

The heat generated by the fixation assembly 36 is removed as explained below.

The heat generated by the fixation assembly 36 is transmitted (conducted) upward (in the arrow C direction), or obliquely upward (in the arrow D direction) The heat transmitted in the direction of the arrow C is released though the apertures 16*b*, whereas the heat transmitted in the direction of the arrow D is released though the apertures 12*a*. Shielding plates 37 are provided on the reverse face of the sheet-receiving tray 16 (inside face of the casing 12) to insulate the optical unit 18 from the heat generated in the fixation assembly 36. The shielding plates 37 are placed between the fixation assembly 36 and the optical unit 18, protruding downward from the underside of the sheet-receiving tray 16.

The heat generated by the electronic assembly 46 and the main motor 48 is removed as explained below.

The sheet delivery guide 44 for guiding the recording paper sheet P from the registration roller 32 to the fixation assembly 36 is nearly continuous without a gap, and is inclined to rise obliquely from the upstream side toward the downstream side of the delivery direction. In this example, the inclination is designed to be at about 30°. Therefore, the heat generated in the electronic assembly 46 and the main motor 48 is transmitted in the arrow E direction under the sheet delivery guide 44, and further through the gap between the fixation assembly 36 and the backside wall of the casing 12 in the arrow F direction to be released through the aperture 12*a*. The electronic assembly 46 is supported by a stay 47 which has many apertures 47*a*. Cool air under the casing 12 is allowed to enter the inside of the casing 12 upward through the apertures 47*a*. This air cools the electronic assembly 46 and the main motor 48, and ascends in the inside of the casing 12. Thereby the heat generated in the electronic assembly 46 and the main motor 48 is effectively removed.

Release of the heat from the sheet-receiving tray 16 is explained in the case where a recording paper sheet P is held on the sheet-receiving tray.

The recording paper sheet P after completion of the job (having an image fixed thereon) is discharged onto the sheet-receiving tray 16 with the fixed image facing downward. The recording paper sheet P having just been discharged from the sheet discharge port 42 still holds heat since it has just passed through the fixation assembly 36. The sheet-receiving tray 16 has ribs 17 as mentioned above, and the recording paper sheet P having discharged from the sheet discharge port 42 is held in contact with the upper edges of the ribs 17. Therefore, an interspace 50 is formed between the surface (face having the apertures 16*a*,16*b*) of the sheet-receiving tray 16 and the recording sheet P in contact with the rib 17 as shown in FIG. 2. During discharge of the recording paper sheet P from the sheet discharge port 42, air is allowed to flow in the arrow G direction. This air flow causes transmission of the heat released from the apertures 16*a*,16*b* in the arrow G direction through the interspace 50 to the outside of the laser beam printer 10.

Removal of the heat is explained in the case where recording paper sheets are successively fed (the recording paper sheets P are successively discharged from the sheet discharge port 42).

With plural recording sheets held on the sheet-receiving tray, usually the heat is released from the uppermost sheet only, not released from the lower layered paper sheets, and the accumulated heat is released slowly. In contrast, in the present invention, the heat is released also from the lower side.

The height of the three ribs 17 in this example is explained below.

The three ribs 17 are constituted of a rib 17*a* formed in the middle portion in the width direction (arrow W direction) of the tray, and two ribs 17*a*,17*b* formed at the both end portions of the width direction. The two ribs 17*b*,17*b* are higher than the rib 17*a*. This difference of the height of the three ribs 17*a*,17*b*,17*b* enables hot air to flow in the arrow H direction, facilitating the heat removal. Incidentally, the heat removal is facilitated by increasing the distance between the rib 17*a* and the rib 17*b*.

EXAMPLE 2

Example 2 is explained by reference to FIGS. 6-8.

FIG. 6 is a perspective view of a sheet-receiving tray. FIG. 7 is an enlarged view of FIG. 7. FIG. 8 is a sectional view taken at the line J-J in FIG. 7. In these drawings, the same symbols are used for the corresponding constitutional elements as in FIGS. 1-5.

Example 2 is characteristic in that protrusions 60 are formed in place of the ribs 17 in Example 1 on the sheet-receiving tray 16, and that an auxiliary tray 70 is provided for covering the sheet-receiving tray 16. This auxiliary tray 70 will be explained later in Example 3.

The protrusions 60 are formed on the surface of the sheet-receiving tray 16, and are extended in the sheet discharge direction (in the arrow A direction). The two protrusions 60 are placed respectively outside the center portion in the width direction (in the arrow W direction). On the side walls of the protrusions 60 facing outward or inward in the width direction, plural apertures 60*a* are made. Also on the side walls of the protrusions 60 facing to the downstream side in the paper sheet discharge direction, plural apertures 60*b* are formed. The heat generated in the fixation assembly 36 (FIG. 1) and other parts is released not only through the apertures 16*a*,16*b* but also through the apertures 60*a*,60*b*. Thereby, the heat is more effectively released from the inside of the casing 12. The distance between the two protrusions 60,60 is preferably made larger for facilitating the heat release.

The protrusions 60 have respectively an upper face 60*c* tilting to become lower from the outer side toward the inner side in the width direction as shown in FIG. 8.*or* the upper faces 60*c* respectively tilting to rise from the inner side toward the outer side in the width direction. The tilted upper faces 60*c* of the two protrusions 60 facilitate the hot air to flow also in the arrow H direction to release the heat.

EXAMPLE 3

Example 3 is explained by reference to FIGS. 9-11.

FIG. 9 is a side view showing a sheet-receiving tray provided with an auxiliary tray. FIG. 10 is a perspective view of the auxiliary tray of FIG. 9. FIG. 11 is a side view showing transmission of the heat with the auxiliary tray of FIG. 9 closed. In these drawings, the same symbols are used for corresponding constituting members as in FIGS. 1-5.

The laser beam printer 13 in Example 3 is characterized by the auxiliary tray 80 which serves to cover the sheet-receiving tray 16. The auxiliary tray 8*b* is turnable around the turning axis 82 in the arrow J directions. The turning axis 82 is positioned on the downstream side of the sheet receiving tray 16 in the paper sheet discharging direction (in the arrow A direction). The auxiliary tray 80 covers the sheet-receiving tray 16 at a closing position (at the position shown by a solid line in FIG. 12). Thereby, the auxiliary tray prevents penetration of dirt or dust through the apertures 16*a*,16*b* of the sheet-receiving tray 16 into the laser beam printer 13, or soiling of the recording paper sheet P held on the sheet-receiving tray 16. On the other hand, with the auxiliary tray 80 kept at an opening position (at the position shown by the two-dot chain line in FIG. 12), the sheet-receiving tray 16 can hold many recording paper sheets P. Therefore, for holding many recording paper sheets P on the sheet-receiving tray 16, the auxiliary tray 80 is kept opened.

The auxiliary tray 80 has an opening 84 in a size for passing the maximum size of the recording paper sheet P in the laser beam printer 13. This opening 84 is made at the portion of the auxiliary tray 80 in a closing state at the downstream side in the paper sheet discharge direction. The opening 84 is nearly at the same position as the turning axis 82. Thereby, even when the auxiliary tray 80 is in a closed state, the recording paper sheet P can be taken out through the opening 84 without paper sheet jamming.

The transmission of the heat in a state that the recording paper sheet P is held on the sheet-receiving tray 16 is explained below.

The heat generated by the heat-generating sources of the laser beam printer 13 is transmitted through the apertures 16*a*,16*b* and through the space under the recording paper sheet P held on the sheet-receiving tray 16 in the arrow G direction, and is released outward. The generated heat is transmitted also above the recording paper sheet P in the arrow K direction, thereby the heat removal being more effective.

EXPLANATION OF NUMERICAL SYMBOLS

Figure 1:
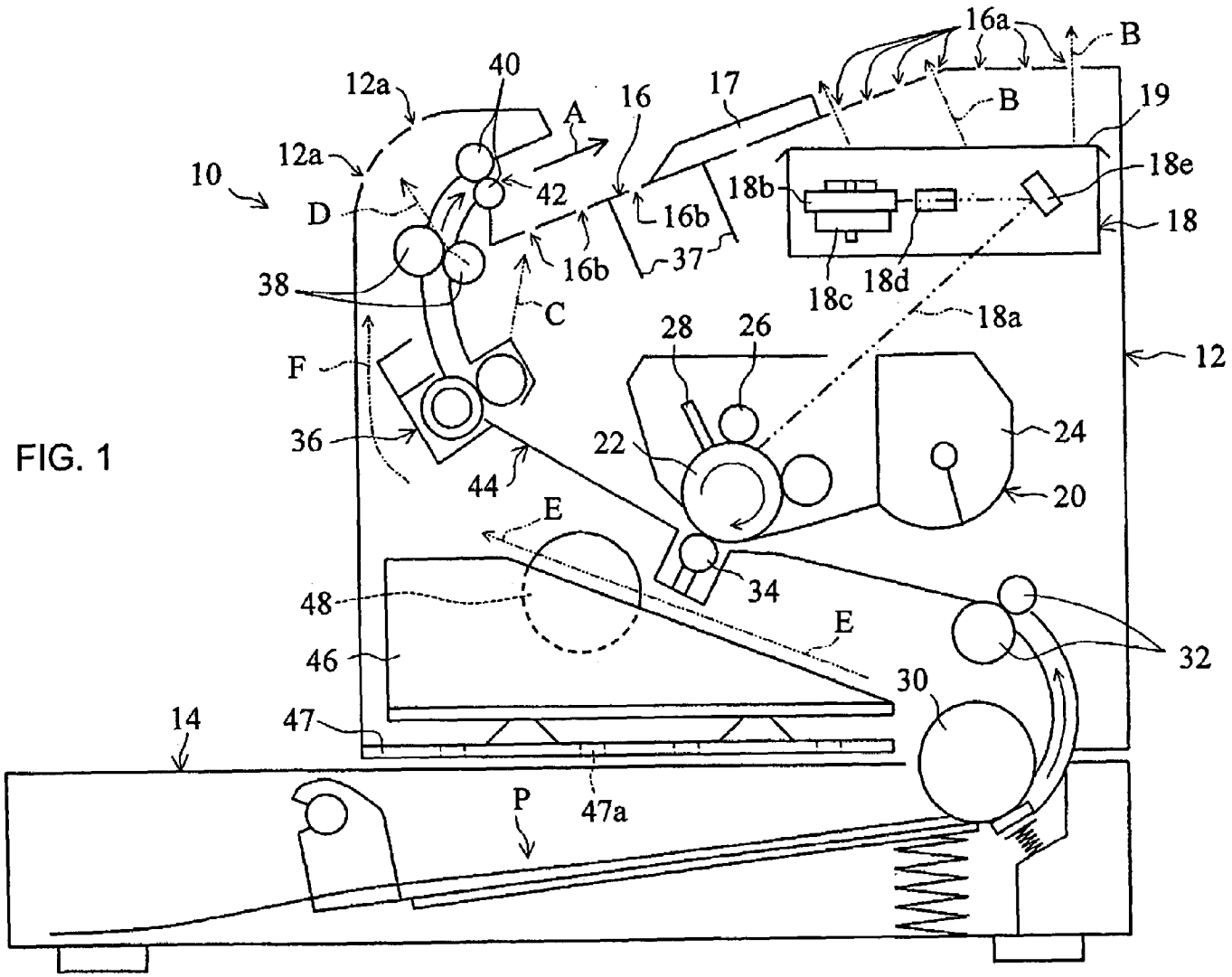
FIG. 1 A side view, showing constitution of a laser beam printer of an example, FIG. 2 A side view of the laser beam printer of FIG. 1, holding a recording medium sheet on a sheet-receiving tray, FIG. 3 A side view, showing the flow of heat.
Figure 2:
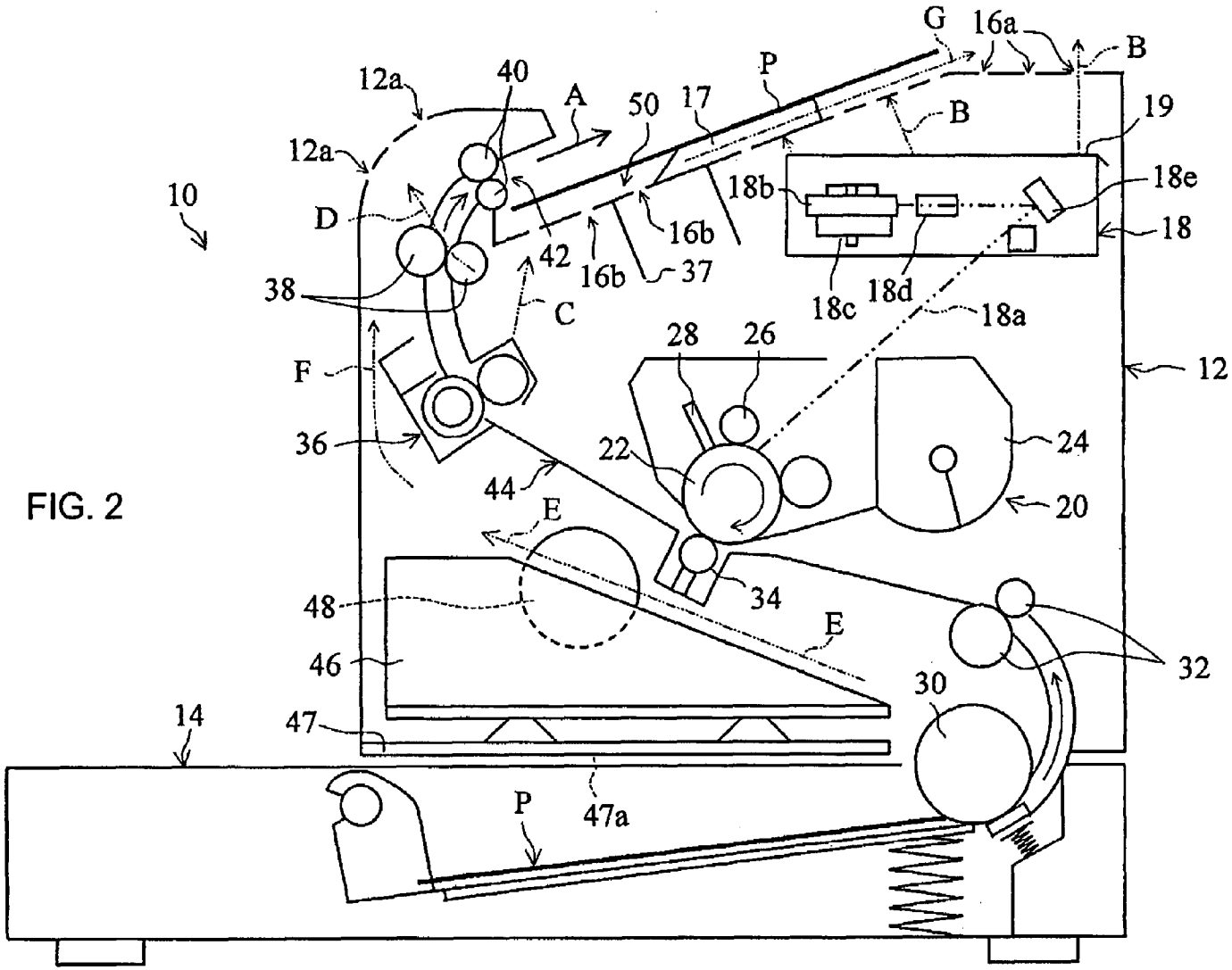
Figure 3:
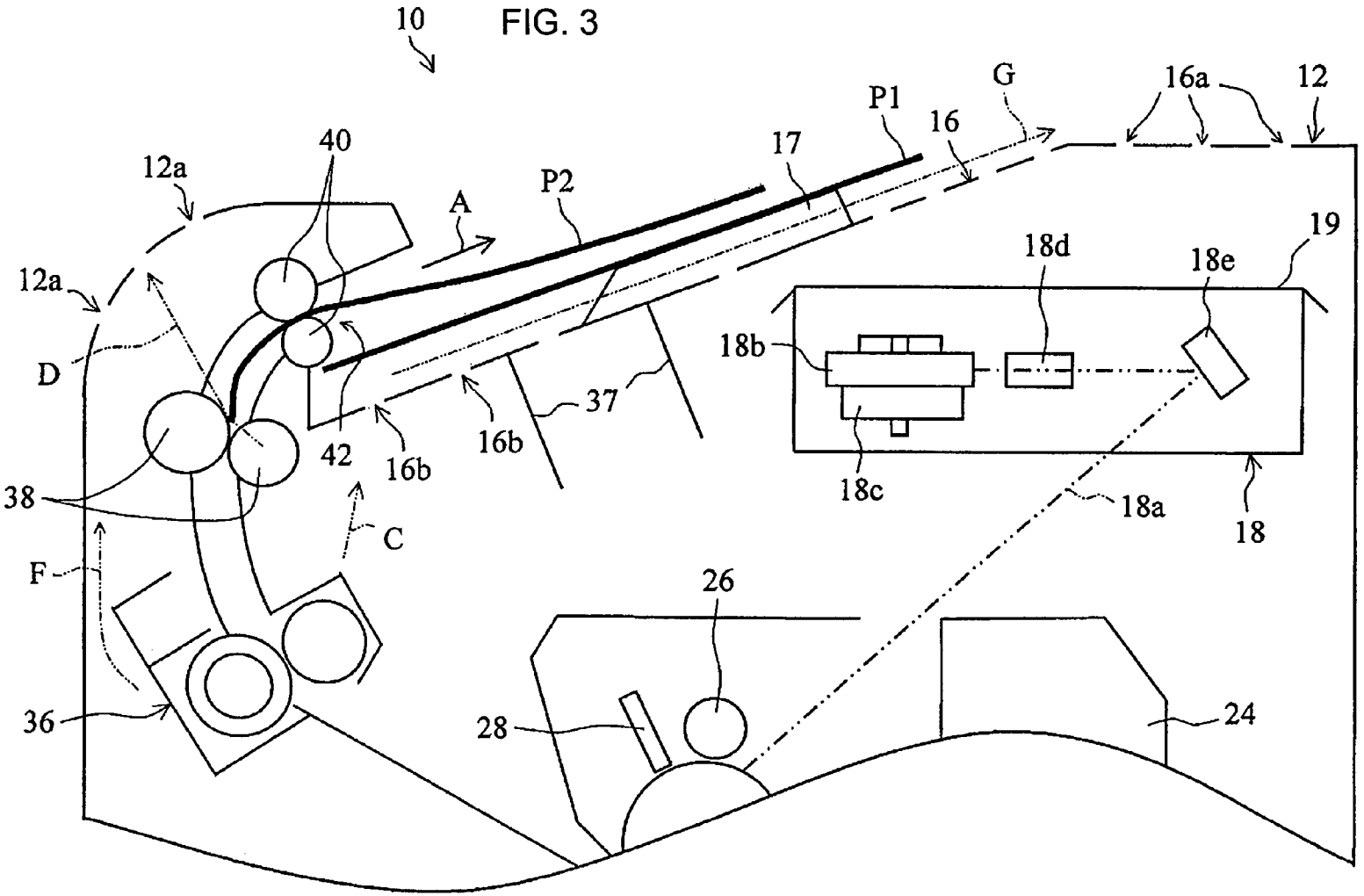
Figure 4:
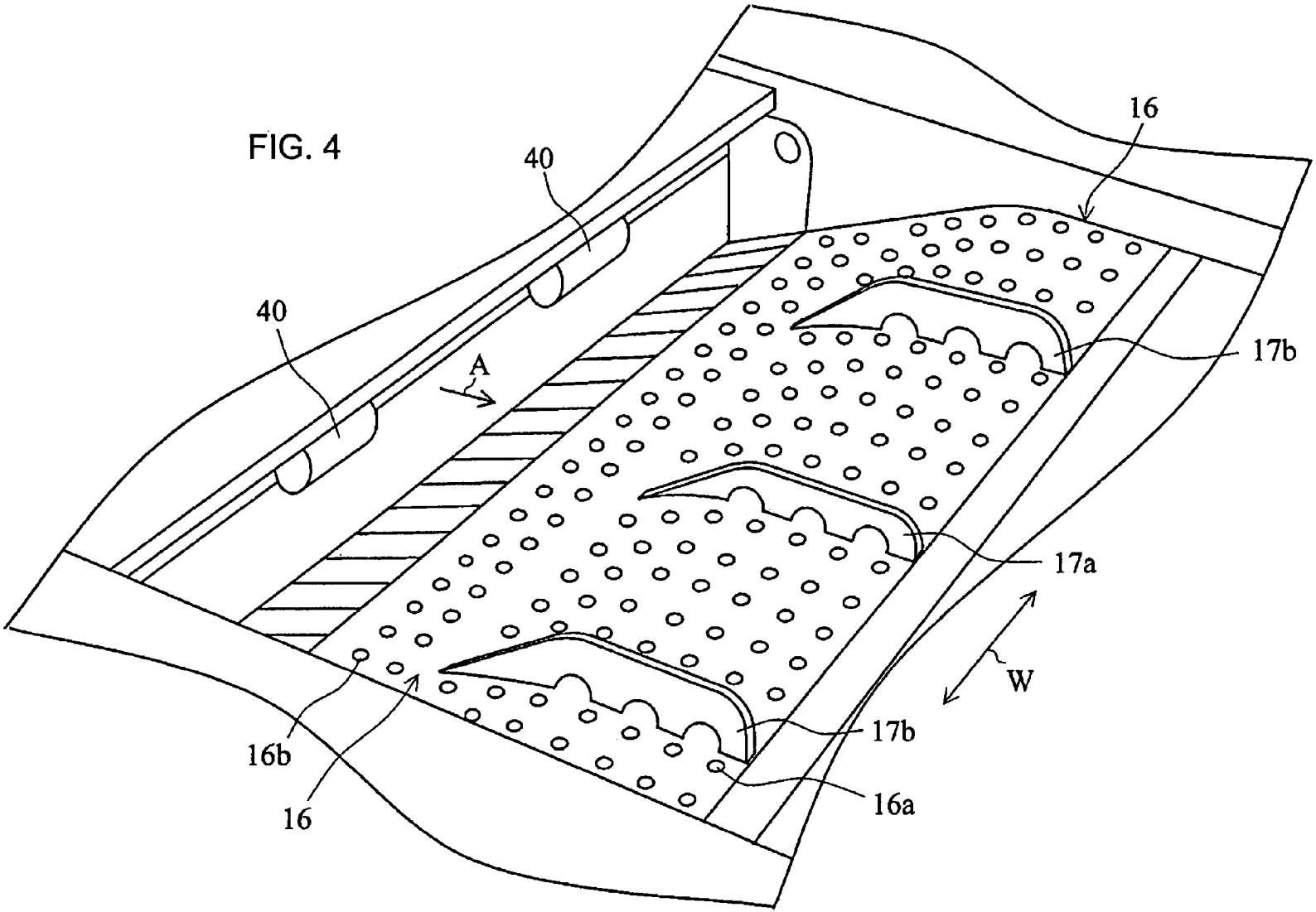
FIG. 4 A perspective view of the sheet-receiving tray.
Figure 5:
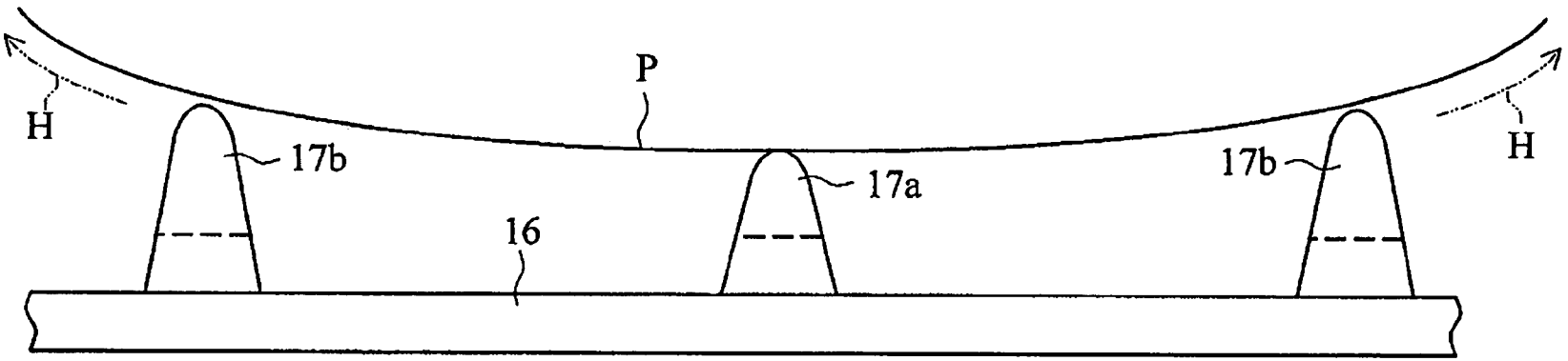
FIG. 5 A front view showing the shape of ribs.
Figure 6:
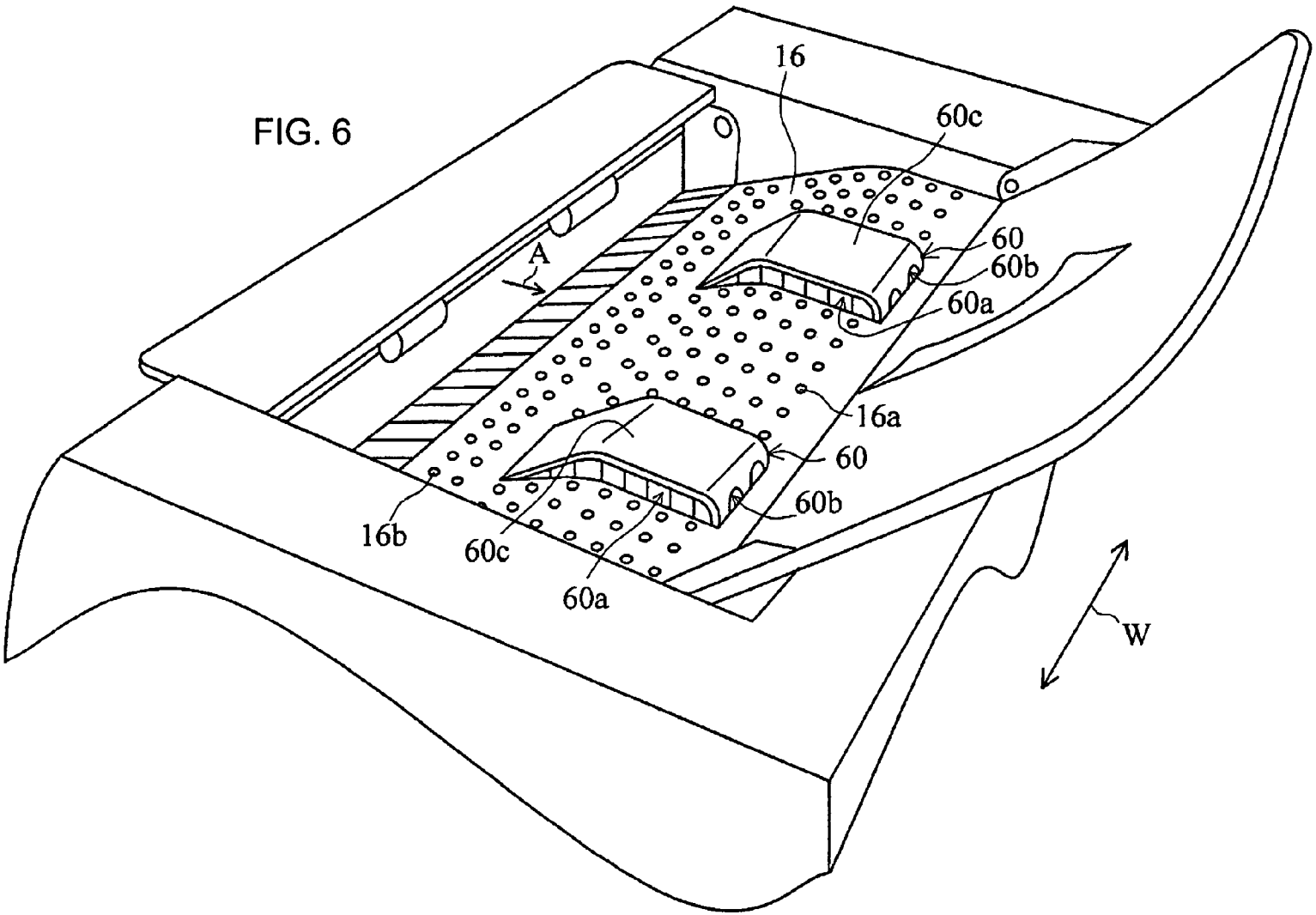
FIG. 6 A perspective view of a sheet-receiving tray.
Figure 7:
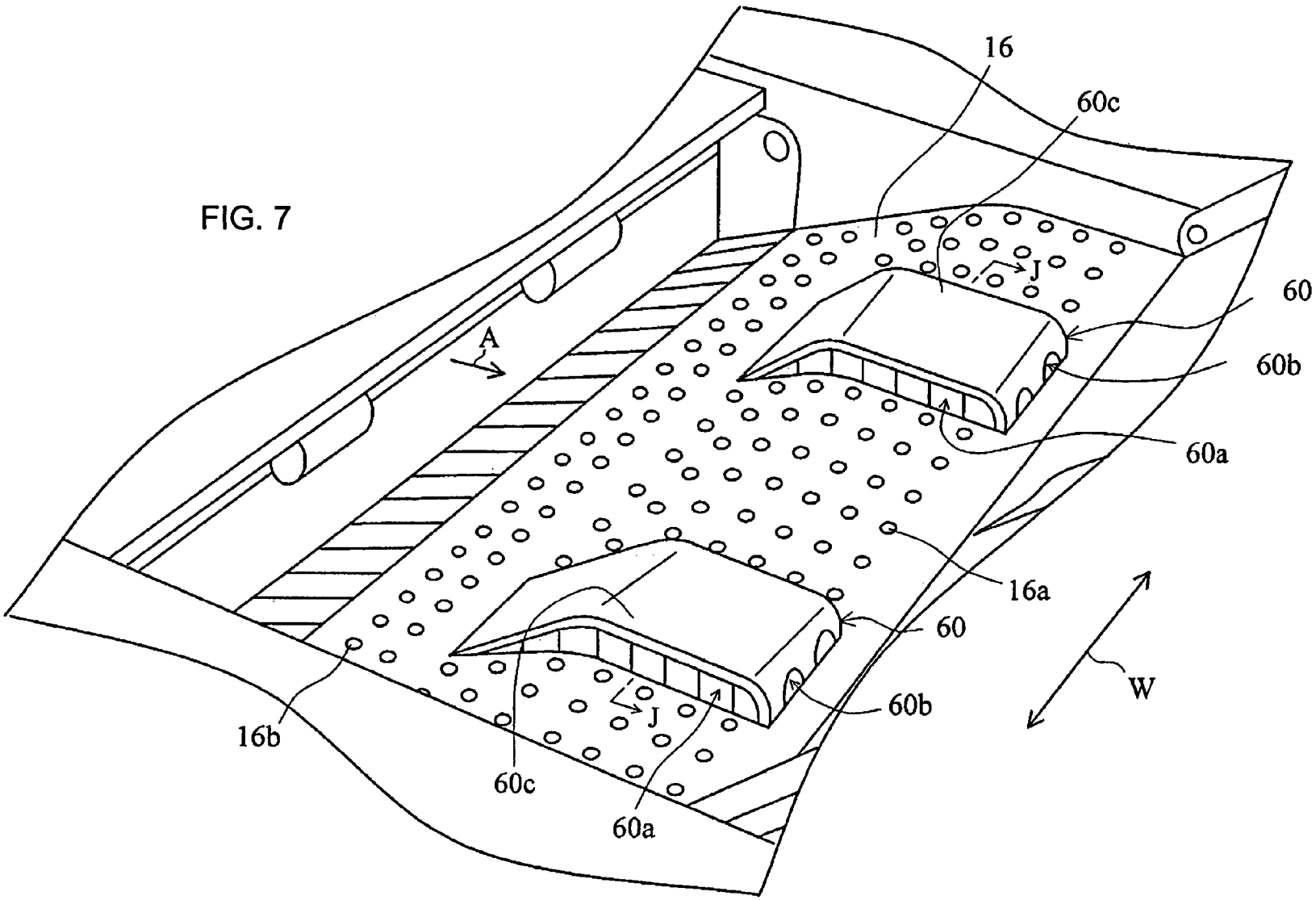
FIG. 7 An enlarged view of FIG. 6.
Figure 8:
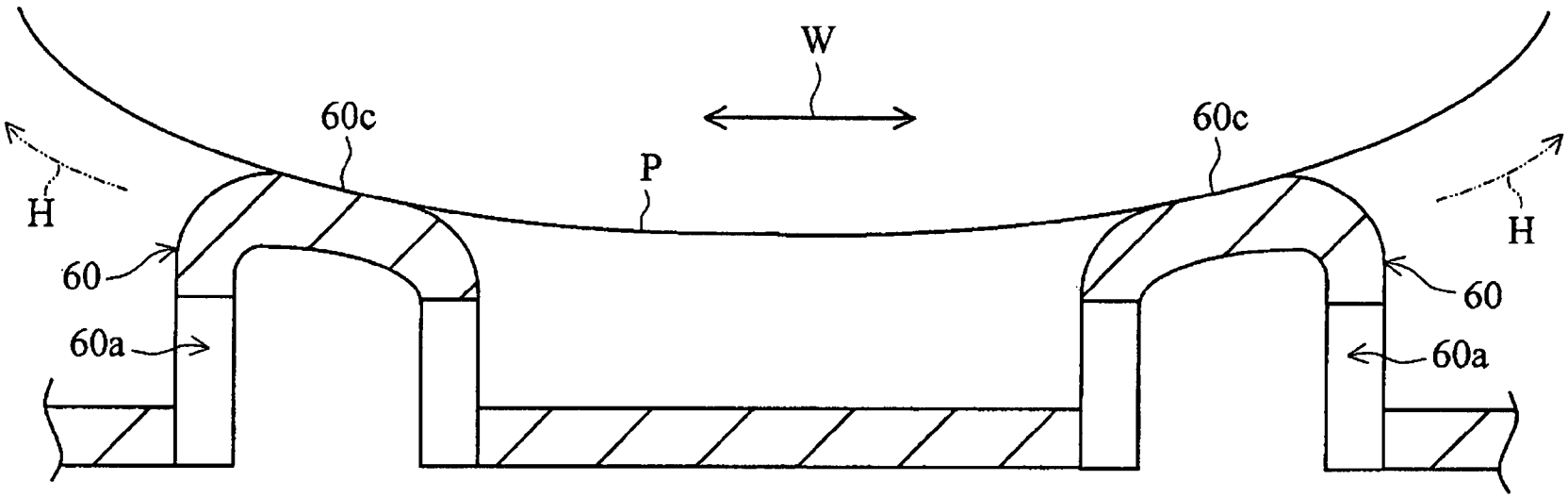
FIG. 8 A sectional view at J-J in FIG. 7.
Figure 9:
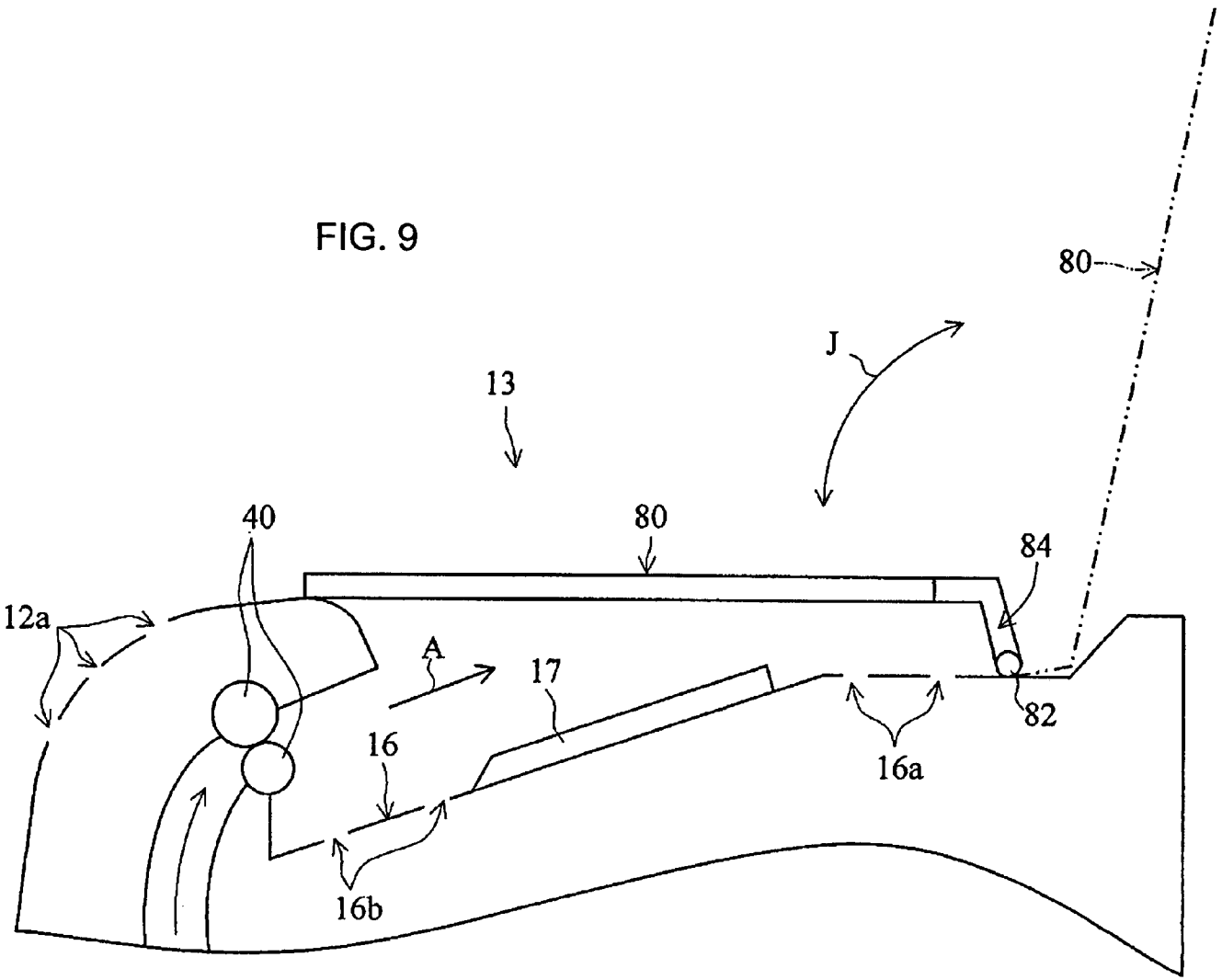
FIG. 9 A side view, showing a sheet-receiving tray with an auxiliary tray attached thereto, FIG. 10 A perspective view of the auxiliary tray of FIG. 9, FIG. 11 A side view, showing a flow of heat with the auxiliary tray of FIG. 9 kept closed.
Figure 10:
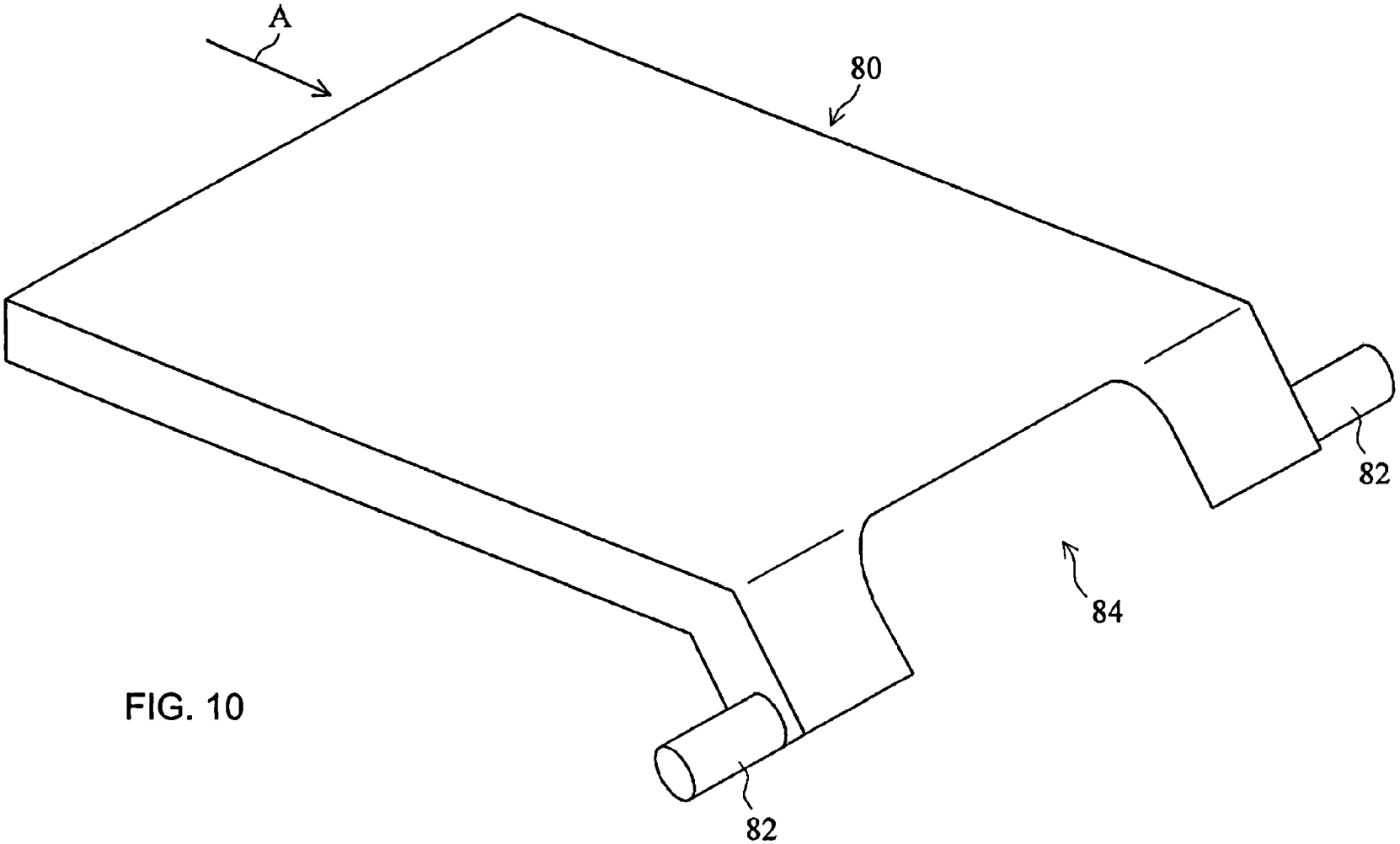
Figure 11:
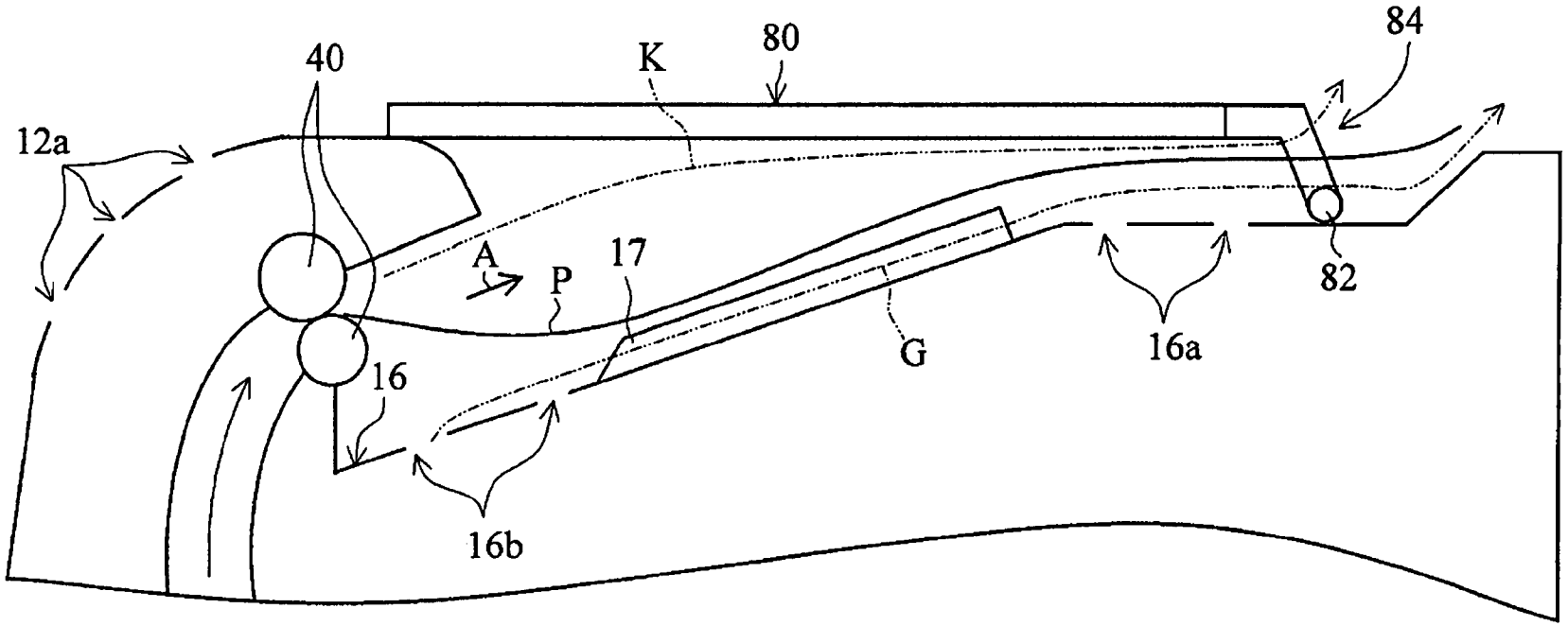

10 Laser beam printer,
16 Sheet-receiving tray,
16*a*,16*b* Aperture
17 Rib
36,70 Fixation assembly
37 Shielding plate
46 Electronic assembly
47 Stay
60 Protrusion
60*a*,60*b* Aperture
80 Auxiliary tray
84 Opening

The invention claimed is:

1. An image-forming apparatus having a sheet discharge port for discharging a recording medium sheet having an image formed thereon in a prescribed sheet discharge direction, and a sheet-receiving tray extending from under the sheet discharge port in the sheet discharge direction for receiving the recording medium sheet; and discharging the recording medium sheet having the image formed thereon from the sheet discharge port onto a surface of the sheet-receiving tray; wherein the sheet-receiving tray has apertures on the surface of the sheet-receiving tray to connect the inside of the apparatus body to outside air to enable heat generated by the apparatus to be removed by escaping through the apertures, and a spacer mechanism disposed on the surface of the sheet-receiving tray to maintain the recording medium spaced from said apertures.

2. The image-forming apparatus according to claim 1, wherein said spacer mechanism comprises ribs rising from the surface of the sheet-receiving tray extending in the sheet discharge direction, wherein at least one of said ribs has openings therein along portions thereof adjacent to the surface.

3. The image-forming apparatus according to claim 2, wherein the ribs are constituted of three or more ribs arranged in the width direction of the recording medium sheet held on the sheet-receiving tray; and of the three or more ribs, the ribs at the end portions in the width direction is higher than that at the middle portion.

4. An image-forming apparatus having a sheet discharge port for discharging a recording medium sheet having an image formed thereon in a prescribed sheet discharge direction, and a sheet-receiving tray extending from under the sheet discharge port in the sheet discharge direction for receiving the recording medium sheet; and discharging the recording medium sheet having the image formed thereon from the sheet discharge port onto the sheet-receiving tray; wherein the sheet-receiving tray has apertures to connect the inside of the apparatus body to outside air, wherein the sheet-receiving tray has, on the surface thereof, protrusions having apertures for connection of the inside of the apparatus body to the outside thereof, the apertures facing to the direction perpendicular to the sheet discharge direction.

5. The image-forming apparatus according to claim 4, wherein the protrusions have an aperture facing to the downstream side of the sheet discharge direction for connection of the inside of the apparatus body to the outside thereof.

6. The image-forming apparatus according to claim 4 or 5, wherein the protrusions have an upper face tilting to become lower from the outer side toward the inner side in the width direction of the recording medium held on the sheet-receiving tray.

7. The image-forming apparatus according to claim 6, wherein the apparatus has a fixation assembly for fixing the image by heating, and the sheet-receiving tray placed above the fixation assembly.

8. The image-forming apparatus according to claim 6, wherein the apparatus has an electronic assembly incorporating electric and electronic parts, and a stay having apertures for passing air upward for supporting the electronic assembly.

9. The image-forming apparatus according to any of claims 1 to 5, wherein the apparatus has a fixation assembly for fixing the image by heating, and the sheet-receiving tray placed above the fixation assembly.

10. The image-forming apparatus according to claim 9, wherein the apparatus has an electronic assembly incorporating electric and electronic parts, and a stay having apertures for passing air upward for supporting the electronic assembly.

11. The image-forming apparatus according to any of claims 1 to 5, wherein the apparatus has an electronic assembly incorporating electric and electronic parts, and a stay having apertures for passing air upward for supporting the electronic assembly.

12. The image-forming apparatus according to claim 4, wherein the sheet-receiving tray has ribs rising from the surface thereof, extending in the sheet discharge direction, and having openings.

13. The image-forming apparatus according to claim 12, wherein the ribs are constituted of three or more ribs arranged in the width direction of the recording medium sheet held on the sheet-receiving tray; and of the three or more ribs, the ribs at the end portions in the width direction is higher than that at the middle portion.

14. The image-forming apparatus according to claim 13, wherein the protrusions have an aperture facing to the downstream side of the sheet discharge direction for connection of the inside of the apparatus body to the outside thereof.

15. The image-forming apparatus according to claim 13, wherein the protrusions have an upper face tilting to become lower from the outer side toward the inner side in the width direction of the recording medium held on the sheet-receiving tray.

16. The image-forming apparatus according to claim 12, wherein the protrusions have an aperture facing to the downstream side of the sheet discharge direction for connection of the inside of the apparatus body to the outside thereof.

17. The image-forming apparatus according to claim 12, wherein the protrusions have an upper face tilting to become lower from the outer side toward the inner side in the width direction of the recording medium held on the sheet-receiving tray.

18. The image-forming apparatus according to claim 4, wherein the protrusions have an upper face tilting to become lower from the outer side toward the inner side in the width direction of the recording medium held on the sheet-receiving tray.

* * * * *